United States Patent [19]

Sears et al.

[11] 4,362,911

[45] Dec. 7, 1982

[54] MEMBRANE KEYBOARD SWITCH ASSEMBLY HAVING SELECTABLE TACTILE PROPERTIES

[75] Inventors: Ronald J. Sears, Middletown; Jack R. Gross, Waynesville, both of Ohio

[73] Assignee: NCR Corporation, Dayton, Ohio

[21] Appl. No.: 187,904

[22] Filed: Sep. 17, 1980

[51] Int. Cl.[3] ..... H01H 13/70

[52] U.S. Cl. ..... 200/5 A; 200/86 R; 200/159 B

[58] Field of Search ..... 200/1, 5 R, 5 A, 85, 200/86 R, 159 B

[56] References Cited

U.S. PATENT DOCUMENTS

| | | | |
|---|---|---|---|
| 3,308,253 | 3/1967 | Krakinowski | 200/86 R X |
| 3,617,666 | 11/1971 | Braue | 200/86 |
| 3,723,673 | 3/1973 | Clary et al. | 200/1 R |
| 3,860,771 | 1/1975 | Lynn et al. | 200/5 A |
| 3,996,428 | 12/1976 | Buan et al. | 200/5 A |
| 4,068,369 | 1/1978 | Kaminski | 29/622 |
| 4,090,045 | 5/1978 | Marsh | 200/5 A |
| 4,090,045 | 5/1978 | Marsh | 200/5 A |
| 4,137,116 | 1/1979 | Miller | 156/269 |
| 4,172,216 | 10/1979 | O'Shea | 200/85 R |
| 4,190,748 | 2/1980 | Langford | 200/5 A |
| 4,246,452 | 1/1981 | Chandler | 200/5 A |

OTHER PUBLICATIONS

Hayes, R. K. et al., "Snap-Action Membrane Switch Keyboard", IBM Technical Disclosure Bulletin, vol. 7, No. 12, May 1965, p. 1168.

*Primary Examiner*—J. R. Scott

*Attorney, Agent, or Firm*—J. T. Cavender; Albert L. Sessler, Jr.; Elmer Wargo

[57] ABSTRACT

A "membrane"-type keyboard includes a resilient foam layer having an array of holes therein with the layer being sandwiched between first and second flexible membranes having electrical conductors thereon which are arranged to complete a circuit associated with a hole when the first and second membranes are moved toward each other. Embodiments including dome-shaped areas in the first flexible membranes provide for "tactile feedback" and additional foam layers enhance the operating characteristics of the embodiments. The method generally entails determining the operating parameters of a desired keyboard and simply changing the relative density and/or thicknesses of various layers and flexible membranes in the keyboard to obtain radically variable paremeters, as for example, the location of the "makepoint" of the switch at various positions between the start and end of "key travel."

7 Claims, 13 Drawing Figures

MEMBRANE KEYBOARD SWITCH ASSEMBLY HAVING SELECTABLE TACTILE PROPERTIES

BACKGROUND OF THE INVENTION

As small computer systems decrease in cost, the cost of the associated keyboards becomes a larger percentage of the total manufacturing cost and becomes a prime target for cost reduction. At the same time, keyboards for these small computer systems must meet stringent operator entry performance requirements for alpha-numerics and must also enable the manufacturer thereof to provide many custom design features intended to provide a competitive advantage for the associated keyboards and systems. Consequently, a successful keyswitch or keyboard design must simultaneously meet the requirements of low-materials costs, good operator performance, durability, and low manufacturing costs for both standard and custom production runs. A keyswitch that meets these requirements would also be useful in small control panels or individual momentary closure switch modules.

The "flexible membrane" technologies which were developed for hand calculator keyboards provide favorable cost advantages. The designs of these keyboards however, have several unfavorable properties which restrict efficient operator performance at a computer terminal or increase materials and manufacturing costs. First, the switch makepoint during actuation is often located at the end of switch travel. The consequent lack of aftertravel shocks the operator's finger by preventing follow-through movements. Second, the designs very often have high activation forces and severely limited switch travel (less than 20/1000ths of an inch). Third, attempts to increase switch travel and to provide tactile feedback in the switch action by molding domes into the "flexible membrane" reduce switch durability because of "fatigue cracking" around the domes. In addition, since the snap action associated with the domes is still limited by a relatively short travel, the improvement in tactile feel is limited.

Most membrane switch designs incorporate a solid dielectric spacer sheet between a moving flexible sheet or membrane and an associated, nonmoving electrical contact facing it. This spacer sheet has apertures in it which correspond to each switch's electrical contacts. The flexible membrane is pressed through an aperture to contact the associated bottom circuit and make a "keyed" electrical connection. Another prior art switch utilizes a resilient material in place of the spacer sheet and also uses multiple graphic overlay sheets and a mesh screen used as the conductor; however, this construction produces a switch with high operating forces and limited actuation travel.

In summary, one of the above named membrane switch designs will permit high operator performance levels at a computer terminal or related utilization devices. This poor performance results from high operating forces, limited switch travel, and makepoints at the bottom of switch travel. Prior attempts to increase switch travel or to add tactile feedback to the switch designs discussed above either reduce the durability of the switches or increase their cost.

SUMMARY OF THE INVENTION

In contrast with the prior art keyboards, the various embodiments of this invention:

1. Decrease switch actuation forces.
2. Increase switch travel.
3. Increase the tactile feel associated with completing a circuit.
4. Increase the mechanical and electrical lives of the keyboards, and
5. Maintain or improve the cost advantages associated with "membrane switch" designs.

In one embodiment of this invention, the electrical switch array comprises a layer of dielectric, resilient material having a plurality of holes arranged in a pattern therein; a first, flexible, dielectric sheet having first and second sides and also having a plurality of dome-shaped areas therein with the convex sides of said dome-shaped areas being located on the second side and the dome-shaped areas being aligned with said holes in the layer so that the first side faces the layer; and a second dielectric member having first and second sides with the first side facing the layer; and with the first sides of the first sheet and the second member having first and second electrode means arranged, respectively, thereon for completing an electrical connection represented by a dome-shaped area when the dome-shaped area is moved into its associated hole to enable the first electrode means to contact the second electrode means.

In another embodiment of this invention, the electrical switch array or keyboard comprises a layer of dielectric, resilient material having a plurality of holes arranged in a pattern therein; a first, flexible, dielectric sheet having first and second sides and also having a plurality of dome-shaped, snap-action areas therein with the convex sides of the areas being located on the second side and the areas being aligned with the holes in the layer so that the first side faces the layer; a second flexible dielectric sheet having first and second sides with the first side facing the layer; the first sides of the first and second sheets having first and second electrode means arranged, respectively, thereon for completing an electrical connection represented by an area when the area is moved into its associated hole to enable the first electrode means to contact the second electrode means; a first plate extending over the array; a second layer of resilient material positioned between the second face of the second sheet and the first plate; a second plate having a plurality of support holes therein aligned with the holes in the layer; a third layer of resilient material positioned between the second plate and the second side of the first sheet; and actuable keys slidably mounted in the support holes for moving the associated dome-shaped snap-action areas into their associated holes in the layer.

The method of producing an electrical switch according to this invention for one embodiment thereof comprises (a) determining the force desired to actuate the switch, the extent of travel of the switch, and the location of a makepoint between the start and end of the travel of the switch whereby an electrical connection is made at the makepoint; (b) selecting the density of the first, second and third layers and the first and second sheets in accordance with said force desired to actuate the switch; and (c) selecting the thicknesses of the first, second, and third layers in accordance with the determination as to the location of the makepoint within the travel of the switch.

DETAILED DESCRIPTION OF THE INVENTION

Figure 1:
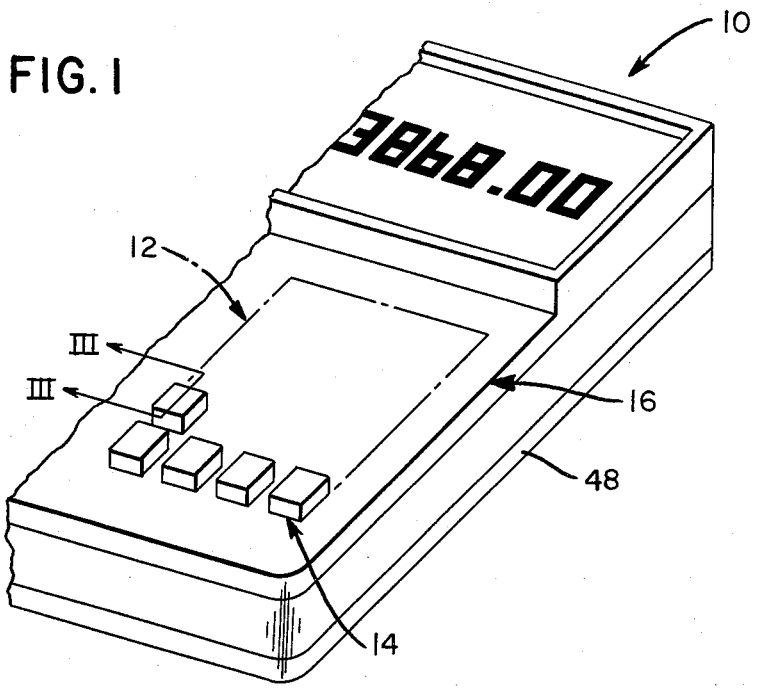
FIG. 1 is a general, perspective view of a utilization device such as a computer system (only a portion of which is shown) in which a keyboard, shown only generally, but made according to this invention, may be used.

FIG. 1 shows a typical utilization device such as a portion of a computer system 10 in which a keyboard, designated generally as 12 and made according to this invention, may be used.

Figure 3:
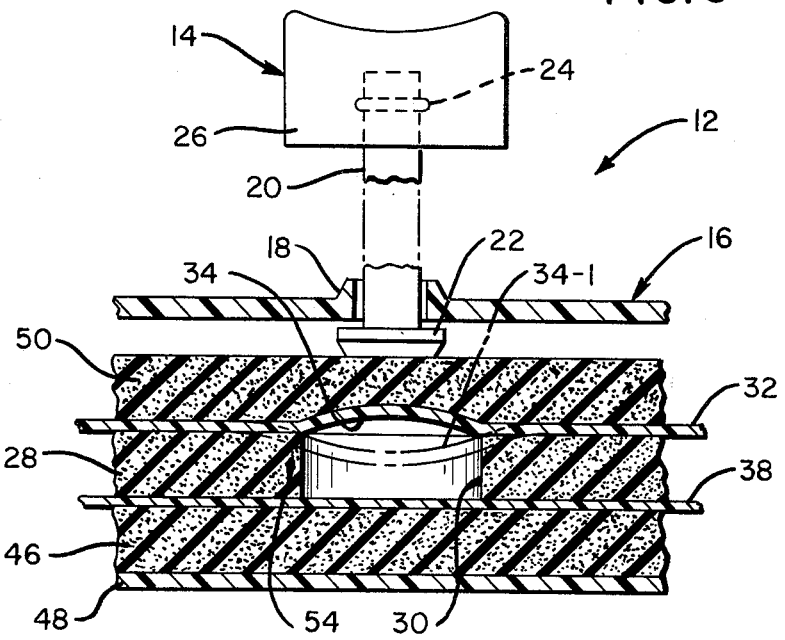
FIG. 3 is a cross-sectional view of one embodiment of the keyboard shown in FIGS. 1 and 2 and is taken along the line 3—3 of FIG. 1.
Figure 2:
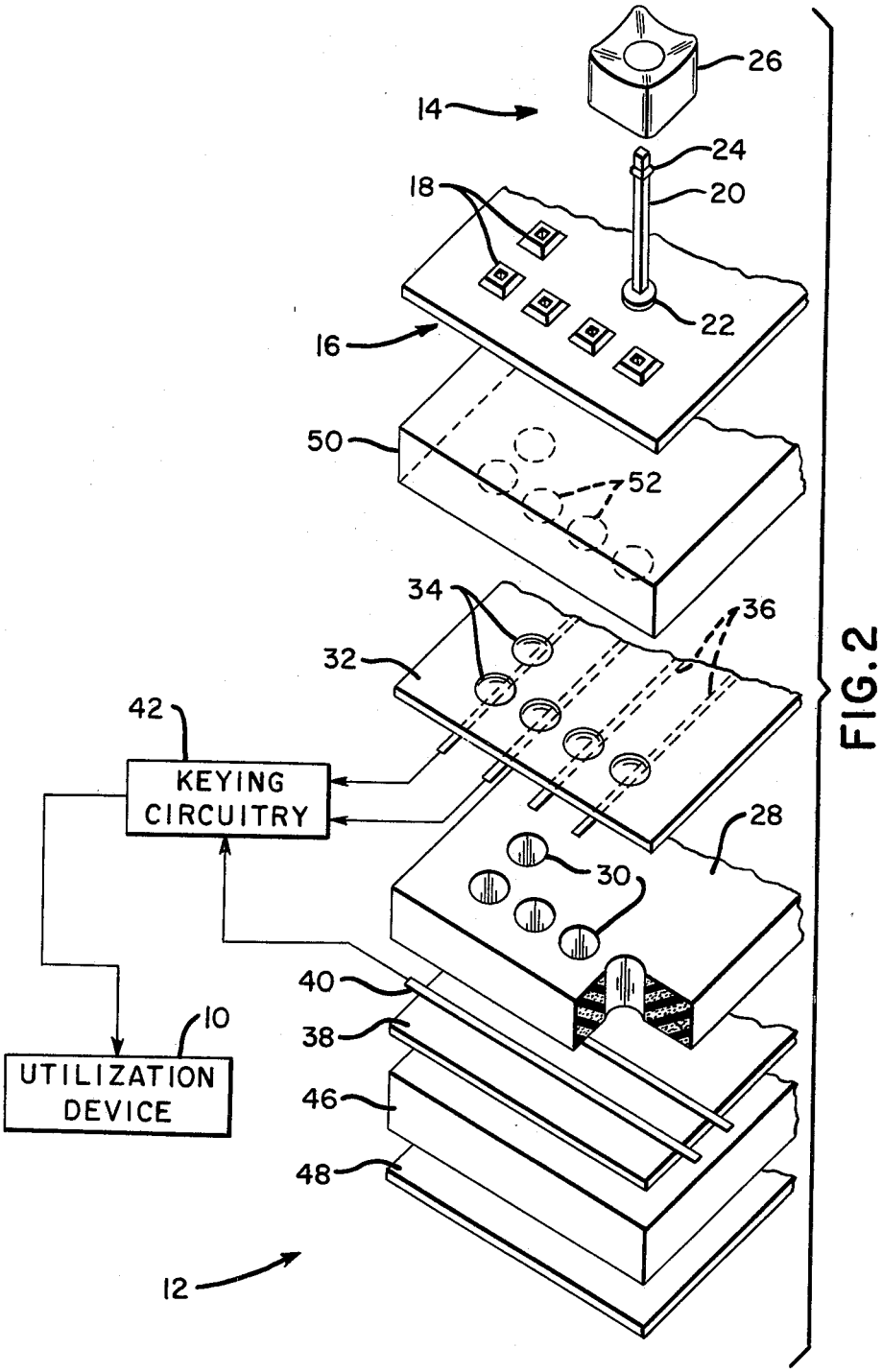
FIG. 2 is an expanded or exploded view, in perspective, of one embodiment of the keyboard shown only generally in FIG. 1.

The keyboard 12 (FIG. 1), which represents a first embodiment of this invention, is shown in more detail in FIGS. 2 and 3. The keyboard 12 includes a plurality of keys 14 (only a few are shown) which are arranged in a predetermined pattern or array and are slidably mounted in a guide plate 16. The plate 16 has a plurality of square, flanged openings 18 therein to slidably receive the square key stems 20. Each key stem 20 has an enlarged actuation area 22 on one end thereof which is positioned on one side of plate 16 and also has a ribbed area 24 located on the other end thereof. The ribbed area 24 is used to detachably secure an associated key cap 26 to the key stem 20 to provide a two-piece, key construction which facilitates the assembling of the keyboard 12.

The keyboard 12 is comprised of a plurality of elements as shown in FIGS. 2 and 3. The keyboard 12 includes a first layer 28 of dielectric, resilient material such as flexible foam which has a plurality of holes 30 therein which are arranged in the same pattern or array as are the keys 14, with one such hole 30 being located in alignment with an associated key 14.

A first sheet 32 of flexible, dielectric material having first and second sides is then positioned above the first layer 28 as shown in FIGS. 2 and 3. The sheet 32 has a plurality of dome-shaped areas 34 which are arranged in a predetermined pattern so as to be positioned over an associated hole 30 when the keyboard 12 is in the assembled relationship shown. The areas 34 are located on the second side of sheet 32 and conventional electrode means such as spaced, parallel conductors 36 (FIG. 2) are located on the first side of sheet 32 which faces the first layer 28. Each conductor 36 extends over a column of keys 14, as best seen in FIG. 2. The conductors 36 are flexible and are aligned with an associated column of dome-shaped areas 34.

The keyboard 12 also includes a second sheet 38 of flexible, dielectric material which is positioned below the first layer 28 as shown in FIGS. 2 and 3. The sheet 38 has first and second sides with the first side facing the layer 28 and also having electrode means thereon such as the spaced, parallel conductors 40 which are located on the first side thereof. The conductors 40 are flexible and are aligned with an associated row of dome-shaped areas 34. The electrical conductors 36 and 40 are connected to conventional keying circuitry 42 whose output is connected to a utilization device such as the computer system 10 shown in FIG. 1.

The keyboard 12 also includes a second layer 46 of resilient, dielectric material such as flexible foam which is positioned between the second sheet 38 and a back plate 48. The back plate 48 is made of a rigid material which extends over the entire keyboard 12. Also, the keyboard 12 includes a third layer 50 of resilient, dielectric material which may be a flat layer or one which has a plurality of concave areas or recesses 52 therein. When the keyboard 12 is in the assembled relationship shown in FIG. 3, for example, the recesses 52 (when present) are aligned with and are complementary to the dome-shaped areas 34 in the first sheet 32.

Figure 4:
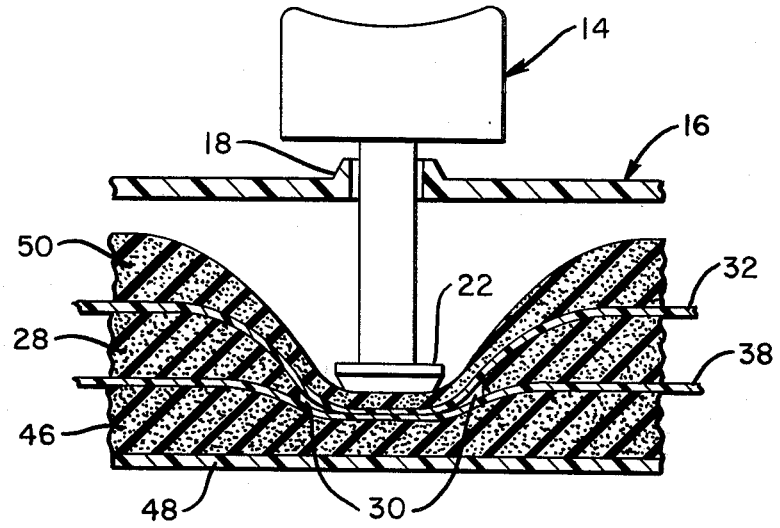
FIG. 4 is a view similar to FIG. 3 showing a key which has been depressed beyond the makepoint and is in the aftertravel area.

The operation of the keyboard 12 (FIGS. 2 and 3) is as follows. When a key 14 is depressed by a user's finger, the actuation area 22 of the associated key 14 pushes against the third layer 50 which holds the key 14 in the "up" position shown in FIG. 3 and also provides some of the pre-travel of the key 14 prior to an electrical connection being made. As the key 14 is depressed further towards the back plate 48, the associated dome-shaped area 34 "snaps" to the position shown in dashed outline 34-1. The dome-shaped areas 34 provide the tactile feel or "snap action" just before the makepoint of the particular key 14 when the associated conductor 36 on the first sheet 32 contacts the associated conductor 40 on the second sheet 38. As the key 14 is depressed further towards the back plate 48, the perimeter of the associated dome-shaped area 34 is supported by the portion 54 (FIG. 3) of the first layer 28 which surrounds the associated hole 30. The portion 54 supports the perimeter of the associated dome-shaped area 34 and lessens the radius of curvature thereat because the layer 28 deforms as the key 14 is depressed further towards the back plate 48; this prolongs the life of the dome-shaped areas 34 and sheet 32. FIG. 4 shows a key 14 which has been depressed beyond the makepoint (where an electrical connection is made) and is shown in the aftertravel area.

The layer 28 (FIGS. 2 and 3) performs two other functions in addition to the function of increasing the life of first sheet 32 as discussed in the previous paragraph. The layer 28 increases the overall "travel" of the associated key 14 and the travel that occurs as the dome-shaped area 34 "snaps down" which is important in making the tactile feedback more noticeable to the operator.

The second sheet 38 (FIG. 2) has the conductors 40 thereon and provides the other electrical contacts (in conjunction with conductors 36) to complete an electrical circuit under a depressed key 14. Because the second sheet 38 is flexible, it permits switch aftertravel following an electrical circuit being completed. The second layer 46 limits the maximum force which can be applied to the flexible sheets 32 and 38 and thereby reduces wear in the keyboard 12.

As previously stated, this invention enables the construction of membrane-key switches or keyboards which permit easy modification of the force, distance, and tactile properties thereof. For example, "step changes" in force may be obtained by changing the foam densities of all the first, second and third layers 28, 46 and 50, respectively, or less than all of them. Adjustable pretravel and aftertravel may be effected by changing the thicknesses of the third layer 50 and the second layer 46, respectively or by removing them. An adjustable makepoint of the keyboard 12 (or travel of a key 14 before electrical contact is made) can be effected by changing the relative thicknesses of the layers 28, 46, and 50.

In a preferred embodiment of the keyboard 12, the first, second and third layers 28, 46, and 50 are made of a flexible, low-density, foam such as silicone or urethane, for example. The first and second sheets 32 and 38 are made of Mylar ®, polycarbonet, or conductive silicone rubber, for example. Naturally, the thicknesses and densities of the various layers and sheets mentioned in this paragraph are dependent upon the particular force, distance and tactile properties desired in a particular keyboard; however, the following thicknesses of the various sheets and layers are representative:

| ITEM | Range |
|---|---|
| First layer 28 | 0.10–0.50 inch thick |
| Second layer 46 | 0.10–0.50 inch thick |
| Third layer 50 | 0.10–0.50 inch thick |
| First sheet 32 | 0.004–0.050 inch thick (Mylar) |
| | 0.050–0.20 inch thick (Silicone Rubber) |
| Second sheet 38 | 0.004–0.050 inch thick (Mylar) |
| | 0.050–0.020 inch thick (Silicone Rubber) |
| Movement of travel of key 14 | 0.05–0.50 inch. |

Figure 5:
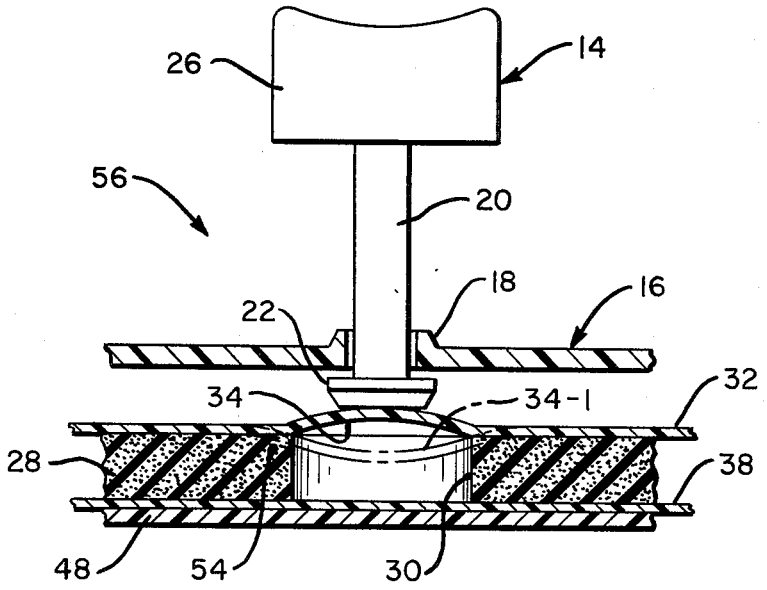
FIG. 5 is a cross-sectional view similar to FIG. 3 of a second embodiment of this invention.

FIG. 5 shows a second embodiment of this invention which is designated generally as keyboard 56, with the same reference numerals in FIG. 5 being used for identical parts of elements in FIGS. 1–3. The first sheet 32 (FIG. 5) is identical to sheet 32 shown in FIG. 2 and it has the electrodes 36 thereon. Similarly, the second sheet 38 (FIG. 5) is identical to sheet 38 shown in FIG. 3 and it has the electrodes 40 thereon.

The operation of the keyboard 56 (FIG. 5) is generally the same as keyboard 12 already described in FIGS. 1–3, except that the first and second layers 46 and 50 shown in FIGS. 2 and 3 have been eliminated. When the key 14 is depressed, the associated dome-shaped area 34 is depressed and "snaps" to the position shown by dashed outline 34-1, and thereafter, continued depression of the key 14 towards the back plate 48 will effect the electrical connection between the associated electrode 36 on the first sheet 32 and the associated electrode 40 on the second sheet 38.

FIGS. 6A, 7A, 8A, and 9A show various "Force vs. Switch Travel" graphs for the switch embodiments shown in FIGS. 6, 7, 8, and 9, respectively. These figures are useful in explaining the method of producing electrical switch arrays according to this invention.

Figure 6:
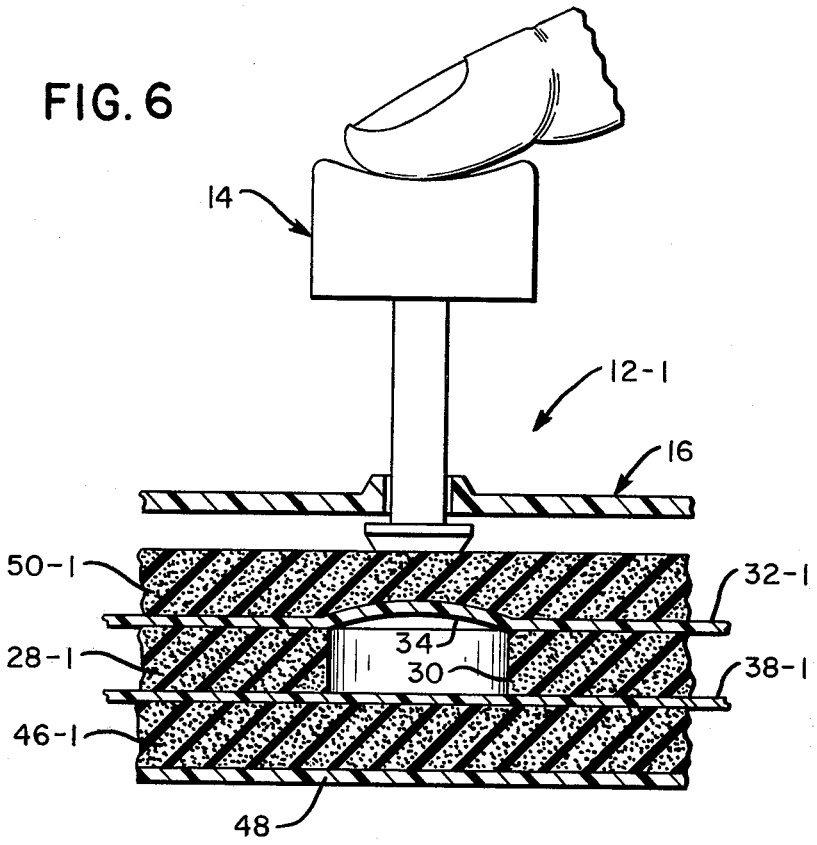
FIGS. 6, 7, 8 and 9 are views of additional embodiments of the invention.

In order to facilitate and explanation of FIGS. 6–9, identical elements are given the same numbers. FIG. 6 is substantially identical to the embodiment shown in FIG. 3; consequently, the layers 28, 50, and 46 shown in FIG. 3, correspond to the layers 28-1, 50-1, and 46-1 shown in FIG. 6. With regard to FIGS. 7–9, whenever the thicknesses of a layer changes, it is given a new dash number; for example the thickness of layer 50-1 in FIG. 6 is increased in FIG. 7, and it is therefore assigned the number 50-2. Layer 50-2 is the same as layer 50-1 except that layer 50-2 is thicker than layer 50-1.

Figure 6A:
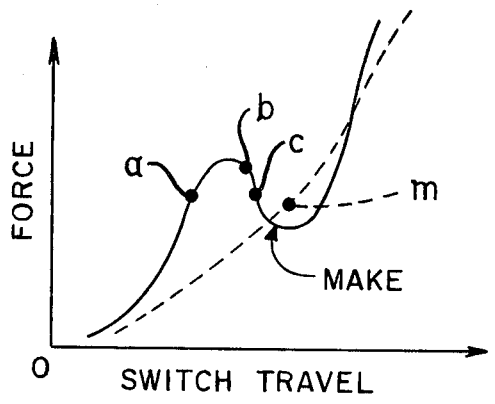
FIGS. 6A, 7A, 8A and 9A show various "Force vs. Switch Travel" graphs for the embodiments shown in FIGS. 6, 7, 8, and 9 respectively.

The "Force vs Switch Travel" graph shown in FIG. 6A depicts the characteristics of the switch 12-1 shown in FIG. 6. The method of producing the switch arrays according to specific design parameters can best be understood by changing the dimensions, for example, of certain elements of the switches 12-1, 12-2, 12-3 and 12-4 and looking at the associated graphs in FIGS. 6A, 7A, 8A and 9A, respectively. Actually, the method of producing switches according to this invention is basically to determine the force, makepoint, and switch travel characteristics desired, and to select the densities and thicknesses of the layers like 28-1 and the sheets like 32-1 used therein. This is a feature of this invention in that the operating characteristics thereof can be changed without tooling changes by the manufacturer.

With regard to the graphs shown in FIGS. 6A–9A, the term "FORCE" as shown in FIG. 6A, for example, refers to the force applied to the key 14 by a finger as shown in FIG. 6, for example. The term "SWITCH TRAVEL" refers to the total extent to which an associated key 14 travels when being depressed or actuated from the position shown in FIG. 6 to the position shown in FIG. 4. Finally, the term "MAKE" refers to the point in the switch travel at which an electrical connection is made by the electrical conductors 36 (FIG. 3) contacting the associated electrical conductors 40 for the associated key 14 as previously explained.

As previously stated, the keyboard 12-1 in FIG. 6 is substantially the same as keyboard 12. Each of the layers 28-1, 46-1 and 50-1 is made of equal thickness and of the same density according to the parameters given earlier herein.

The characteristics of the keyboard 12-1 (FIG. 6) are shown in the graph in FIG. 6A. Notice that when the layers 28-1, 46-1 and 50-1 of keyboard 12-1 are of the same thickness, the MAKE point of the keyboard 12-1 will occur about midway in the SWITCH TRAVEL.

Figure 7:
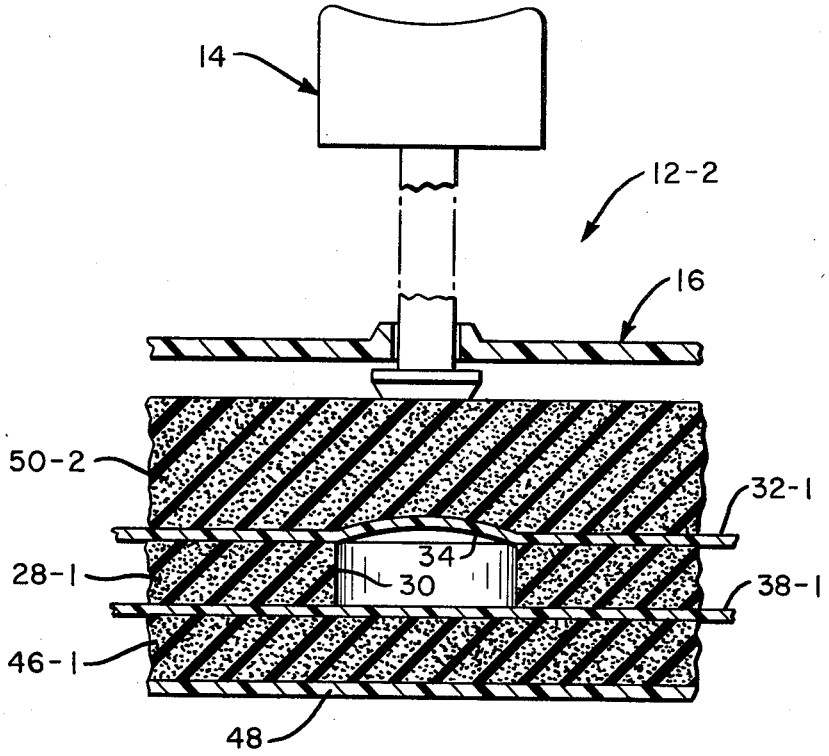
Figure 7A:
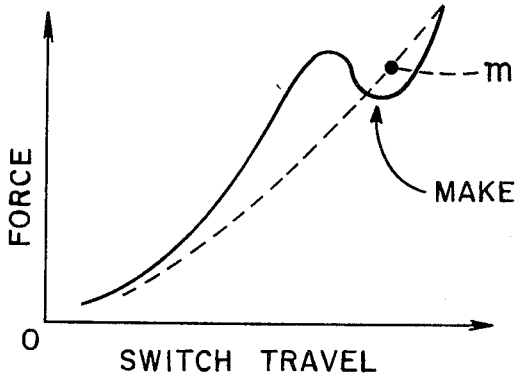

The keyboard 12-2 shown in FIG. 7 is identical to the keyboard 12-1 shown in FIG. 6 except for the fact that the thickness of layer 50-2 in keyboard 12-2 is changed to twice the thickness of layer 50-1 in keyboard 12-1. This change moves the MAKE point of switch 12-2 further along in the SWITCH TRAVEL as seen in FIG. 7A when compared to FIG. 6A. Also, the FORCE required to actuate a key 14 of keyboard 12-2 is greater than that associated with keyboard 12-1.

Figure 8:
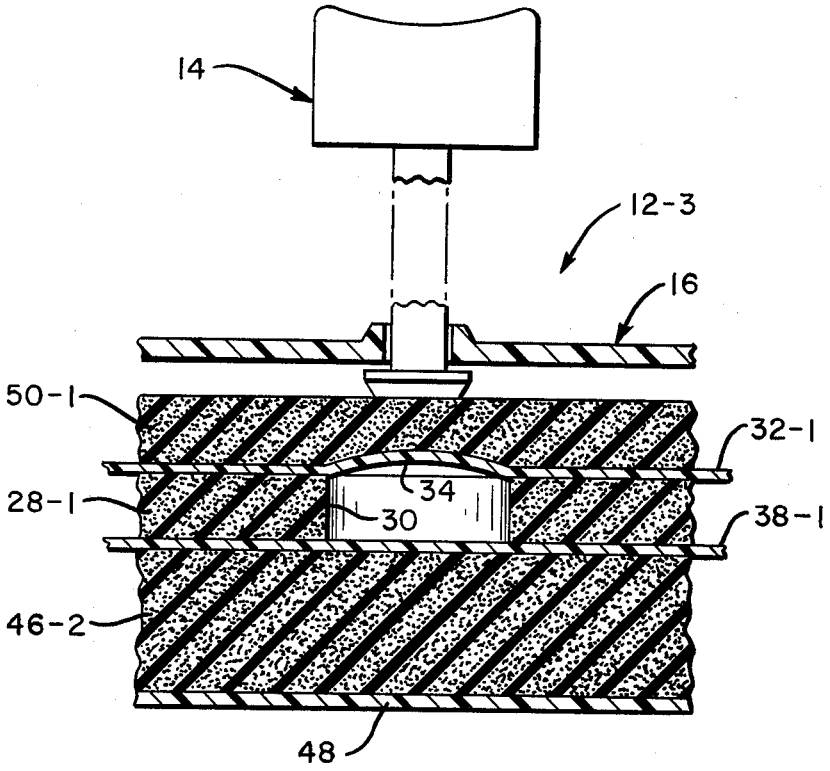
Figure 8A:
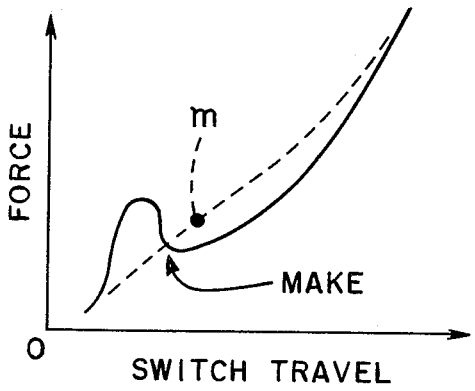

The keyboard 12-3 shown in FIG. 8 is identical to the keyboard 12-1 shown in FIG. 6 except for the fact that the thickness of layer 46-2 in keyboard 12-3 is changed to twice the thickness of layer 46-1 in keyboard 12-1. This change moves the MAKE point of switch 12-3 relatively earlier in the total SWITCH TRAVEL as seen in FIG. 8A when compared to FIG. 6A.

Figure 9:
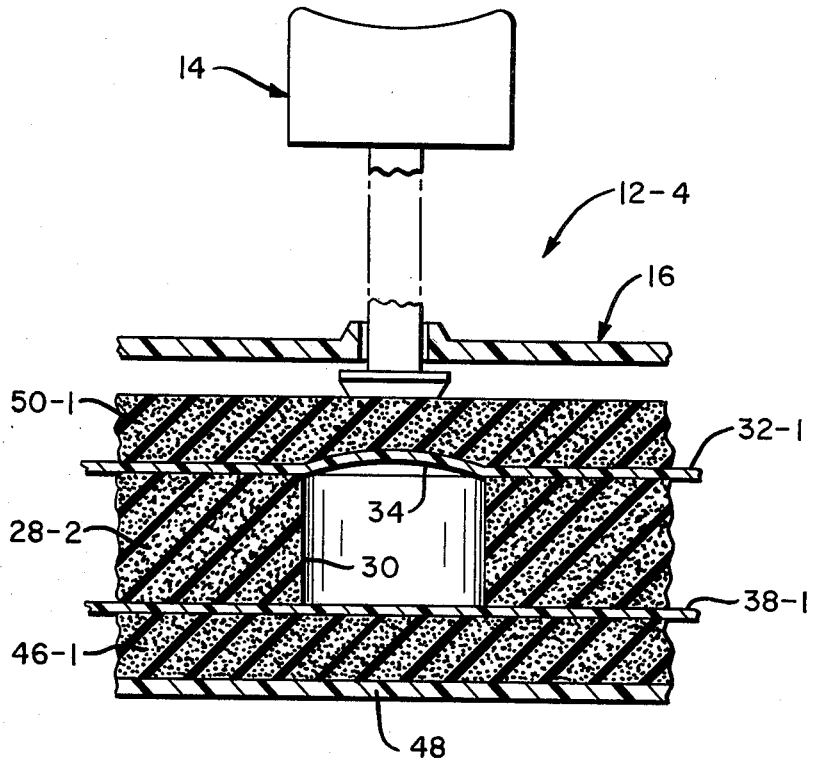
Figure 9A:
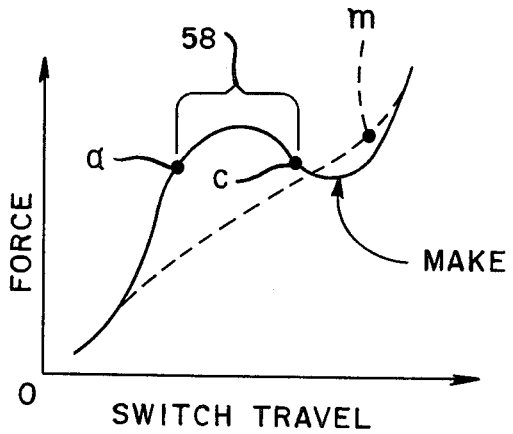

The keyboard 12-4 shown in FIG. 9 is identical to keyboard 12-1 shown in FIG. 6 except for the fact that the thickness of layer 28-2 in keyboard 12-4 is changed to twice the thickness of layer 28-1 in keyboard 12-1. This change widens the "hump" between points "a" and "c" in FIG. 9A (as shown by bracket 58) compared to the distance between points "a" and "c" in FIG. 6A. Also, the FORCE required to actuate a key 14 of the keyboard 12-4 is greater than that associated with keyboard 12-1.

The portion of the graph between points "b" and "c" in FIG. 6A represents a dynamic situation in which an operator has depressed a key 14 with sufficient force or momentum so that as far as actuation of the associated switch (represented by a key 14) is concerned, there is nothing that the operator can do to stop it and the SWITCH TRAVEL represented by the depression of a key 14 proceeds from point c to the MAKE point in FIG. 6A. The points a, b, and c shown in FIG. 6A are not shown in FIGS. 7A and 8A; however, they are similarly located in FIGS. 7A and 8A. This discussion with regard to points a, b, and c of FIGS. 6A and 9A, for example, relates to keyboards having dome-shaped areas 34 therein.

When no dome-shaped areas 34 exist in the first sheet 32-1 shown in FIGS. 6–9, (i.e, with the sheet 32-1 being flat) the associated FORCE vs. SWITCH TRAVEL graphs or curves for the embodiments 12-1 through 12-4 appear in dashed outline as shown in the associated FIGS. 6A–9A, respectively. Notice that without the dome-shaped areas 34, the MAKE points for these embodiments (as shown by the letters "m") appear slightly later in the SWITCH TRAVEL than the embodiments having the dome-shaped areas 34 therein. An important difference here is that with the dome-shaped areas 34 included in the embodiments shown in FIGS. 6–9, an important tactile feel is relayed to the operator to indicate that data has been inputted into the associated keyboards 12-1 though 12-4.

It should also be noted, however, that the use of resilient material in layer 28-1 (FIG. 6, for example) also prolongs the life of the first sheet 32-1 when this first sheet is made flat, without the dome-shaped areas 34 therein. This prolonged life of sheet 32-1 is due to the fact that distortion of the sheet 32-1 is lessened at the perimeter of hole 30 (as at point 54) and the distortion is spread over a broader area of the first sheet 32-1.

In order to achieve very low actuation forces, the sheets 32-1 should be made of silicone rubber.

A typical range of urethane material for use in the layers 28, 46, and 50, for example, as shown in FIG. 3, would be a range of 0.1 to 0.8 pounds per square inch which results from a testing procedure standardized by the American Society for Testing Materials (ASTM-D1564 Method B). In general, the testing procedure entails taking a one inch thick layer of the foam material, compressing an area of 50 square inches of the material by 25% (so that the thickness of the layer is reduced to $\frac{3}{4}$ inch) and measuring the force necessary to compress the layer. Materials which show a force of 0.1 to 0.8 pounds per square inch in such a testing procedure may be used as a starting point for the types of switch embodiments shown herein; however, it is understood that the principles of this invention may be extended to more exotic switch applications.

We claim:

1. An electrical switch array comprising:

a layer of dielectric, resilient material having a plurality of holes arranged in a pattern therein;

a first, flexible, dielectric sheet having first and second sides and also having a plurality of dome-shaped areas therein with the convex sides of said dome-shaped areas being located on said second side and said dome-shaped areas being aligned with said holes in said layer so that said first side faces said layer; and a second dielectric member having first and second sides with said first side facing said layer;

said first sides of said first sheet and second member having first and second electrode means arranged, respectively, thereon for completing an electrical connection represented by a said dome-shaped area when a said dome-shaped area is moved into its associated hole to enable said first electrode means to contact said second electrode means;

said layer of dielectric resilient material being made of flexile foam, such as urethane, and said first dielectric sheet being made of plastic material;

each said dome-shaped area having a size to enable it to be depressed by a user's finger; and said layer of dielectric resilient material being substantially thicker than said first dielectric sheet;

each said dome-shaped area being designed for snap action and also having a perimeter, with each said dome-shaped area having its perimeter aligned with respect to an associated said hole so as to be resiliently supported by a portion of said layer surrounding said hole.

2. An electrical switch array comprising:

a layer of dielectric, resilient material having a plurality of holes arranged in a pattern therein;

a first, flexible, dielectric sheet having first and second sides and also having a plurality of dome-shaped areas therein with the convex sides of said dome-shaped areas being located on said second side and said dome-shaped areas being aligned with said holes in said layer so that said first side faces said layer;

each said dome-shaped area being designed for snap action and also having a perimeter, with each said dome-shaped area having its perimeter aligned with respect to an associated said hole so as to be resiliently supported by a portion of said layer surrounding said hole;

a second flexible dielectric sheet having first and second sides with said first side facing said layer;

said first sides of said first and second sheets having first and second electrode means arranged, respectively, thereon for completing an electrical connection or makepoint represented by a said dome-shaped area when a said dome-shaped area is moved into its associated hole to enable said first electrode means to contact said second electrode means;

a first means for supporting said array; and a second layer of resilient material positioned between said second face of said second sheet and said first supporting means;

said layer of dielectric, resilient material and said second layer of resilient material being substantially thicker than said first and second flexible dielectric sheets, and also the thickness of said layer of dielectric resilient material and said second layer of resilient material being selected so as to affect the location of said makepoint.

3. The array as claimed in claim 2 further comprising:

a second means having support holes therein which are aligned with said holes in said layer;

a third layer of resilient material positioned between said second means and said second side of said first sheet; and actuable keys slidably mounted in said support holes for engaging said third layer and also for moving the associated dome-shaped areas into their associated holes in said layer.

4. The array as claimed in claim 3 in which each of said actuable keys has a length of travel beginning with a start point and ending with an end point, with said makepoint or electrical connection occurring therebetween;

said layer, second layer, and third layer having thicknesses which are selected to locate said makepoint at various positions between said start and end points.

5. The array as claimed in claim 4 in which said layer, second layer and third layer are substantially equal in thickness.

6. An electrical switch array comprising:

a layer of dielectric, resilient material having a plurality of holes arranged in a pattern therein;

a first, flexible, dielectric sheet having first and second sides and also having a plurality of dome-shaped, snap-action areas therein with the convex sides of said areas being located on said second side and said areas being aligned with said holes in said layer so that said first side faces said layer;

a second flexible dielectric sheet having first and second sides with said first side facing said layer;

said first sides of said first and second sheets having first and second electrode means arranged, respectively, thereon for completing an electrical connection or makepoint represented by a said area when a said area is moved into its associated hole to enable said first electrode means to contact said second electrode means;

a first plate extending over said array;

a second layer of resilient material positioned between said second face of said second sheet and said first plate;

a second plate having a plurality of support holes therein aligned with said holes in said layer;

a third layer of resilient material positioned between said second plate and said second side of said first sheet; and actuable keys slidably mounted in said support holes for moving the associated dome-shaped, snap-action areas into their associated holes on said layer;

each said dome-shaped, snap-action area having a perimeter which is supported by a portion of said layer, which said portion surrounds the associated said hole;

said layer, said second layer and said third layer being made of flexible foam such as urethane and said first and second sheets being made of a plastic such as Mylar;

said layer, said second layer, and said third layer each having a thickness which ranges from approximately 0.10 to 0.50 inch, and said first and second sheets each having a thickness of approximately 0.004 to 0.050 inch when said first and second sheets are made of a plastic like Mylar, and said first and second sheets each having a thickness of approximately 0.050 to 0.20 inch when said first and second sheets are made of silicone rubber.

7. The array as claimed in claim 6 in which said third layer has a plurality of concave areas therein arranged in a pattern so that a said concave area contacts an associated dome-shaped snap-action area in said first sheet.

* * * * *